United States Patent [19]

Klos et al.

[11] Patent Number: 4,746,411

[45] Date of Patent: May 24, 1988

[54] ACIDIC SULFATE CONTAINING BATH FOR THE ELECTRODEPOSITION OF ZINC/IRON ALLOYS

[75] Inventors: Klaus-Peter Klos; Karl-Heinz Lindemann; Hermann Donsbach, all of Trebur, Fed. Rep. of Germany

[73] Assignee: Elektro-Brite GmbH, Trebur/Industriegebiet, Fed. Rep. of Germany

[21] Appl. No.: 56,550

[22] Filed: May 29, 1987

[30] Foreign Application Priority Data

Jun. 9, 1986 [DE] Fed. Rep. of Germany ..... 3619385

[51] Int. Cl.[4] ..... C25D 3/56

[52] U.S. Cl. ..... 204/44.2

[58] Field of Search ..... 204/44.2, 44.5

[56] References Cited

U.S. PATENT DOCUMENTS

| | | | |
|---|---|---|---|
| 2,809,156 | 10/1957 | Safranek | 204/44.5 |
| 4,488,942 | 12/1984 | Martin et al. | 204/44.2 |
| 4,540,472 | 9/1985 | Johnson et al. | 204/28 |
| 4,541,903 | 9/1985 | Kyono et al. | 204/28 |
| 4,578,158 | 3/1986 | Kanamaru et al. | 204/44.2 |

FOREIGN PATENT DOCUMENTS

| | | | |
|---|---|---|---|
| 2525242 | 10/1983 | France | 204/44.5 |
| 746418 | 11/1957 | United Kingdom | 204/44.5 |

*Primary Examiner*—G. L. Kaplan

*Attorney, Agent, or Firm*—Kurt Kelman

[57] ABSTRACT

Bright electrodeposits of zinc/iron alloys onto iron of good ductility and adhesion are obtained at low electroplating voltage and high current yield by using a bath containing zinc sulfate, ferrous sulfate, conductive salt, citric acid and alkali metal acetate and, as additional ingredients, saccharin, a naphthalene mono-, -di- or -trisulfonate or a condensation product thereof with formaldehyde and/or an organic complexing agent for iron and further one or more compounds selected from the group consisting of alkali metal cumene sulfonate, alkali metal benzoate, collagen hydrolyzate having a mean molecular weight of from 500 to 2000 and a reducing agent for ferric irons selected from the group consisting of alkali metal bisulfite, alkali metal dithionite and hydroxy ammonium chloride.

3 Claims, No Drawings

ACIDIC SULFATE CONTAINING BATH FOR THE ELECTRODEPOSITION OF ZINC/IRON ALLOYS

The invention relates to an acidic sulfate containing bath for the electrodeposition of zinc/iron alloys onto iron substrates.

From a lecture of T. Adaniya et al "Iron-Zinc Alloy Electroplating on strip" at the Fourth continous strip plating symposium of American Electroplater's Society, Inc., Chicago, 1st to 3rd May 1984, it is known to produce electrodeposits of zinc/iron alloys onto iron, e.g. car body steel sheet, from acidic sulfate containing baths containing a total of 500 gs/liter of ferrous sulfate and zinc sulfate and 30 gs/liter of sodium sulfate, 20 gs/liter of sodium acetate and 5 gs/liter of citric acid at a $p_H$ of 3 and a temperature of 40° C. using a current density of 25 to 150 Amps/dm$^2$ the bath containing iron and zinc in an amount depending from the current density and the weight ratio $$\frac{Fe^{2+}}{Fe^{2+} + Zn^{2+}}$$

of 20 to 80% of iron.

This bath, however, has the disadvantage that the iron content of the alloy is very much dependent from the current density. The iron content in the alloy deposit varies from about 8 percent by weight at 30 Amps/dm$^2$ to 45 percent by weight at 30 Amps/dm$^2$ and reaches 62 percent by weight at 120 Amps/dm$^2$.

Further the electrodeposits lack brightness. For this reason they are used as basic corrosion protective layers onto which lacquers are electrodeposited or coated by other means.

Finally the electrodeposits obtained according to the known process are of low ductility and the adhesive power gives cause to objections.

Object of the invention is to provide a bath for electrodepositing zinc/iron alloys that avoids these aforementioned disadvantages, and, in addition, allows improvements, such as lowering of the deposit voltage and increasing the current yield.

It has been found that surprisingly zinc/iron alloy electrodeposits onto iron substrates are obtained by using a bath containing each 0.5 to 2 moles/liter of zinc sulfate and ferrous sulfate 0.1 to 1.5 moles/liter of conductive salt 0.01 to 0.2 mole/liter of citric acid and 0.2 to 0.5 mole/liter of sodium acetate, as well as further additives at a $p_H$ of 1 to 3.5, the bath being characterised in that as further additives 0.02 to 1.0 gs/liter of saccharin and/or 0.01 to 1.0 gs/liter of a naphthalene mono-, -di-or-trisulfonate or a condensation product thereof with formaldehyde and/or 0.2 to 4.0 gs/liter of an organic complexing agent for iron and further one/or more members selected from the following group of compounds 0.02 to 2.0 gs/liter of an alkali metal cumene sulfonate,
0.01 to 1.0 gs/liter of an alkali metal benzoate,
0.05 to 2.0 gs/liter of a collagen hydrolyzate having a mean molecular weight 500 to 2000 and
0.01 to 2.0 gs/liter of a reducing agent for $Fe^{3+}$ selected from the group consisting of alkali metal sulfite, alkali metal dithionite and Hydroxylammonium chloride are present.

Preferred as conductive salts are the sulfates of sodium, potassium and ammonium, respectively.

The $p_H$ of the bath is preferably adjusted to $p_H$2.5 by means of sulfuric acid or a solution of the hydroxides of sodium, potassium and ammonium, respectively.

Whereas in the bath of the invention the content of saccharin and further of the complexing agent as well as of the naphthalene sulfonate and the condensate thereof with formaldehyde, respectively, is mainly responsible for the brightness of the electrodeposits of the zinc/iron alloys the iron content of the alloy is influenced by saccharin in a way to render it almost independent from current density thus reaching easier reproducibility. Alkali metal cumene sulfonates increase iron content in the deposit thus increasing ductility and adhesion of the deposit.

The complexing agent further contributes to an increase of adhesion, in particular EDTA. The collagen hydrolyzate acts as a brightening agent and further controls the iron content dependent from current density. By the reducing agent that is used according to the practical needs the current yield is increased; the current yield is lowered by an increasing number of $Fe^{3+}$-ions and this number is lowered in the bath by reducing $Fe^{3+}$-ions to $Fe^{2+}$-ions.

The invention is illustrated by the following examples:

| | |
|---|---|
| $ZnSO_4.7H_2O$ | 175 gs/l (1.08 mole/l) |
| $FeSO_2.7H_2O$ | 317 gs/l (1.14 mole/l) |
| $Na_2SO_4$ | 30 gs/l (0.21 mole/l) |
| Sodium acetate | 20 gs/l (0.24 mole/l) |

The ingredients were solved in distilled water up to about 900 cm$^3$ followed by the addition of the constituents of the following examples. Each bath was then adjusted to a $p_H$ of 2.5 with sulfuric acid and finally each bath was filled up to 1 liter with distilled water.

Steel strips measuring 2 cm in width and 2 mm thickness were electrocoated with a zinc/iron alloy coating at a current density of 20 to 100 Amps/dm$^2$, the strips being continuously moved through the bath as a cathode with a speed of 1 m/min. The bath temperature was 50° C.

EXAMPLE I

Basic bath

| | |
|---|---|
| Additives: | 0.4 gs/l of sodium benzoate<br>0.4 gs/l of saccharin<br>0.4 gs/l of sodium cumene sulfonate<br>2.0 gs/l of ethylene diamine tetraacetic acid (EDTA) |
| Result: | Bright very strong and well adhering deposit of zinc/iron with about 40 ± 5% b.w. of Fe which was fairly independent from current density in the range of 30 to 100 Amps/dm$^2$. |

EXAMPLE II

Basic Bath

| | |
|---|---|
| Additives: | 0.4 gs/l of saccharin<br>0.4 gs/l of sodium cumene sulfonate<br>1.0 g/l of EDTA<br>0.1 gs/l of sodium bisulfite |
| Result: | Bright strong and ductile well adhering deposit of Zn/Fe of about 35% b.w. Fe. |

EXAMPLE III

Basic bath

| | |
|---|---|
| Additives | 0.4 gs/l of collagen hydrolyzate, mean molecular weight 500–2000<br>1.5 gs/l of EDTA<br>0.05 gs/l of sodium dithionite |
| Result: | Bright strong very well adhering deposit of Zn/Fe. |

EXAMPLE IV

Basic bath

| | |
|---|---|
| Additives: | 0.2 gs/l of naphthalenedisulfonic acid condensate with HCHO<br>0.2 gs/l of sodium benzoate<br>0.2 gs/l of saccharin<br>0.2 gs/l of sodium cumene sulfonate<br>1.0 gs/l of EDTA |
| Result: | Bright well adhering ductile deposit already at 30 amps/dm$^2$. Iron content of the deposit in the range of 25 to 55 amps/dm$^2$ 40 ± 5% by weight. |

We claim:

1. An acidic sulfate containing zinc and iron containing bath for the electrodeposition of lustrous zinc/iron alloy coatings onto iron containing 0.5 to 2 moles/l of zinc sulfate and 0.5 to 2 moles/l of ferrous sulfate, 0.1 to 0.5 mole/l of a conductive salt, 0.01 to 0.2 mole/l of citric acid and 0.1 to 0.5 mole/l of sodium acetate, the bath having a $p_H$ of 1 to 3.5 and containing further additives characterised in that it contains as further additives 0.02 to 1.0 gs/l of saccharin, in addition or in place of the saccharin 0.01 to 1.0 gs/l of naphthalene mono-, -di-or-trisulfonate and a condensation product thereof with formaldehyde, respectively, and/or 0.2 to 4.0 gs/l of organic complexing agent for iron and, in addition, one or more compounds selected from the group consisting of: 0.02 to 2.0 gs/l of an alkali metal cumene sulfonate, 0.01 to 1.0 g/l of a collagen hydrolyzate having a mean monecular weight of 500 to 2000 and 0.01 to 2 gs/l of a reducing agent for $Fe^{3+}$ selected from a group consisting of alkali metal bisulfate, alkali metal dithionite and hydroxy ammonium chloride.

2. Zinc and iron containing bath as claimed in claim 1 characterised in that it contains the sulfates of sodium, potassium and ammonium, respectively, as conductive salts.

3. Zinc and iron containing bath as claimed in claim 1 characterised in that it contains ethylene diaminetetracetic acid or the alkali metal or ammonium salts thereof as a complexing agent for iron.

* * * * *